US012674366B1

(12) United States Patent
Dave et al.

(10) Patent No.: US 12,674,366 B1
(45) Date of Patent: Jul. 7, 2026

(54) SETTING A DOWNHOLE TOOL WITH LOW PRESSURE CYCLES

(71) Applicant: Halliburton Energy Services, Inc., Houston, TX (US)

(72) Inventors: Jalpan P. Dave, Singapore (SG); Shanu Thottungal Eldho, Singapore (SG); Marc Yves Robert Normand, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/253,406

(22) Filed: Jun. 27, 2025

(51) Int. Cl.
*E21B 23/04* (2006.01)

(52) U.S. Cl.
CPC ..... *E21B 23/042* (2020.05)

(58) Field of Classification Search
CPC .... E21B 23/042; E21B 23/04; E21B 23/0411; E21B 23/04115; E21B 23/0422; E21B 23/06
See application file for complete search history.

(56) References Cited

U.S. PATENT DOCUMENTS

| | | | |
|---|---|---|---|
| 4,515,219 | A | 5/1985 | Beck |
| 4,545,433 | A | 10/1985 | Wambaugh |
| 4,586,526 | A | 5/1986 | Reardon |
| 4,653,588 | A | 3/1987 | White |
| 5,101,904 | A | 4/1992 | Gilbert |
| 5,400,855 | A | 3/1995 | Stepp et al. |
| 5,429,036 | A | 7/1995 | Latos |
| 6,073,708 | A | 6/2000 | Brown et al. |
| 6,289,998 | B1 | 9/2001 | Krueger et al. |
| 7,000,705 | B2 | 2/2006 | Buyers et al. |
| 7,614,454 | B2 | 11/2009 | Buyers et al. |
| 9,309,745 | B2 | 4/2016 | Patel |
| 9,383,029 | B2 | 7/2016 | Scott |

(Continued)

FOREIGN PATENT DOCUMENTS

| | | |
|---|---|---|
| BR | 112021007440 | 7/2021 |
| GB | 2296273 | 6/1996 |

(Continued)

OTHER PUBLICATIONS

"International Patent Application No. PCT/US2024/017650 International Search Report and Written Opinion", Nov. 22, 2024, 12 pages.

(Continued)

*Primary Examiner* — Yanick A Akaragwe
(74) *Attorney, Agent, or Firm* — DeLizio, Peacock, Lewin & Guerra LLP

(57) ABSTRACT

Embodiments of a setting tool, system, and method are disclosed herein. In one embodiment, a setting tool for use downhole in a wellbore comprises a piston chamber configured to be coupled with an activation chamber of a downhole tool; and a resettable piston positioned in the piston chamber. The piston chamber comprises at least a first portion having an area A adjacent to the activation chamber, and a second portion having an area larger than the first portion. A first pressure amount P applied from the surface of the wellbore into the second portion translates the resettable piston toward the activation chamber to increase pressure in the first portion by an amount larger than P.

20 Claims, 13 Drawing Sheets

(56) References Cited

U.S. PATENT DOCUMENTS

| | | | | |
|---|---|---|---|---|
| 9,551,200 | B2 | 1/2017 | Read et al. | |
| 10,066,466 | B2 | 9/2018 | Radtke | |
| 10,132,135 | B2 | 11/2018 | Gaude | |
| 10,781,661 | B2 * | 9/2020 | Tanguy | E21B 33/127 |
| 2005/0011678 | A1 | 1/2005 | Akinlade et al. | |
| 2010/0243234 | A1 | 9/2010 | Saltel | |
| 2011/0088946 | A1 | 4/2011 | Moore et al. | |
| 2011/0232474 | A1 | 9/2011 | Geiger | |
| 2014/0190708 | A1 | 7/2014 | Hallundbaek | |
| 2014/0216755 | A1 * | 8/2014 | Hallund | E21B 33/127 166/387 |
| 2016/0024897 | A1 | 1/2016 | Greci et al. | |
| 2016/0160850 | A1 | 6/2016 | Mcnichol | |
| 2016/0326804 | A1 | 11/2016 | Gao | |
| 2017/0321515 | A1 * | 11/2017 | Stæhr | E21B 33/1277 |
| 2017/0343019 | A1 | 11/2017 | Thomson et al. | |
| 2018/0142530 | A1 * | 5/2018 | Bane | E21B 34/10 |
| 2021/0047893 | A1 | 2/2021 | Hrupp et al. | |
| 2022/0090457 | A1 | 3/2022 | Tanguy et al. | |
| 2022/0186579 | A1 | 6/2022 | Pelto et al. | |
| 2023/0003106 | A1 * | 1/2023 | Conzemius | E21B 47/095 |
| 2023/0272685 | A1 | 8/2023 | Dave et al. | |
| 2023/0304374 | A1 | 9/2023 | Eldho et al. | |
| 2025/0223882 | A1 | 7/2025 | Dave et al. | |
| 2025/0270892 | A1 | 8/2025 | Dave et al. | |

FOREIGN PATENT DOCUMENTS

| | | |
|---|---|---|
| GB | 2552994 | 2/2018 |
| WO | 1999035365 | 7/1999 |
| WO | 2016051180 | 4/2016 |
| WO | 2018033708 | 2/2018 |

OTHER PUBLICATIONS

Bartnicki, et al., "The Research of Hydraulic Pressure Intensifier for Use in Electric Drive System", IEEE Access, 2018, 2018, 6 pages.

Halliburton Energy Services, Inc, "Endurance Hydraulic Screen®", YouTube video, posted on Halliburton's channel and available at https://www.youtube.com/watch?v=hKkSMAOm8A4, 2021, 1 page (website screenshot submitted), 2021, 1 page.

Saltel Industries, "Expandable Steel Packer for Improving Primary Cementing", YouTube video, posted onSaltel's channel and available at https://www.youtube.com/watch?v=OY5pbjnh-iY, Apr. 19, 2019, 1 page (website screenshot submitted), 2019, 1 page.

"U.S. Appl. No. 18/590,085 Non-Final Office Action", Jun. 9, 2025, 11 pages.

"PCT Application No. PCT/US2025/037988 International Search Report and Written Opinion", Mar. 26, 2026, 11 pages.

* cited by examiner

SETTING A DOWNHOLE TOOL WITH LOW PRESSURE CYCLES

TECHNICAL FIELD

The disclosure generally relates to the field of subsurface operations and, more specifically, to a method and tool for setting or actuating an actuable element using low pressure cycles.

BACKGROUND

A drilling operation may be utilized to construct the fluid conduits which are capable of producing hydrocarbons disposed in subterranean formations. Wellbores may be constructed, in increments, as sections, which sequentially extend into a subterranean formation. The sections may be separated or isolated from other parts of the wellbore, in some examples, by hydraulic or hydrostatically set tools, such as packers.

BRIEF DESCRIPTION OF THE DRAWINGS

Aspects of the disclosure may be better understood by referencing the accompanying drawings.

DETAILED DESCRIPTION

Figure 1:
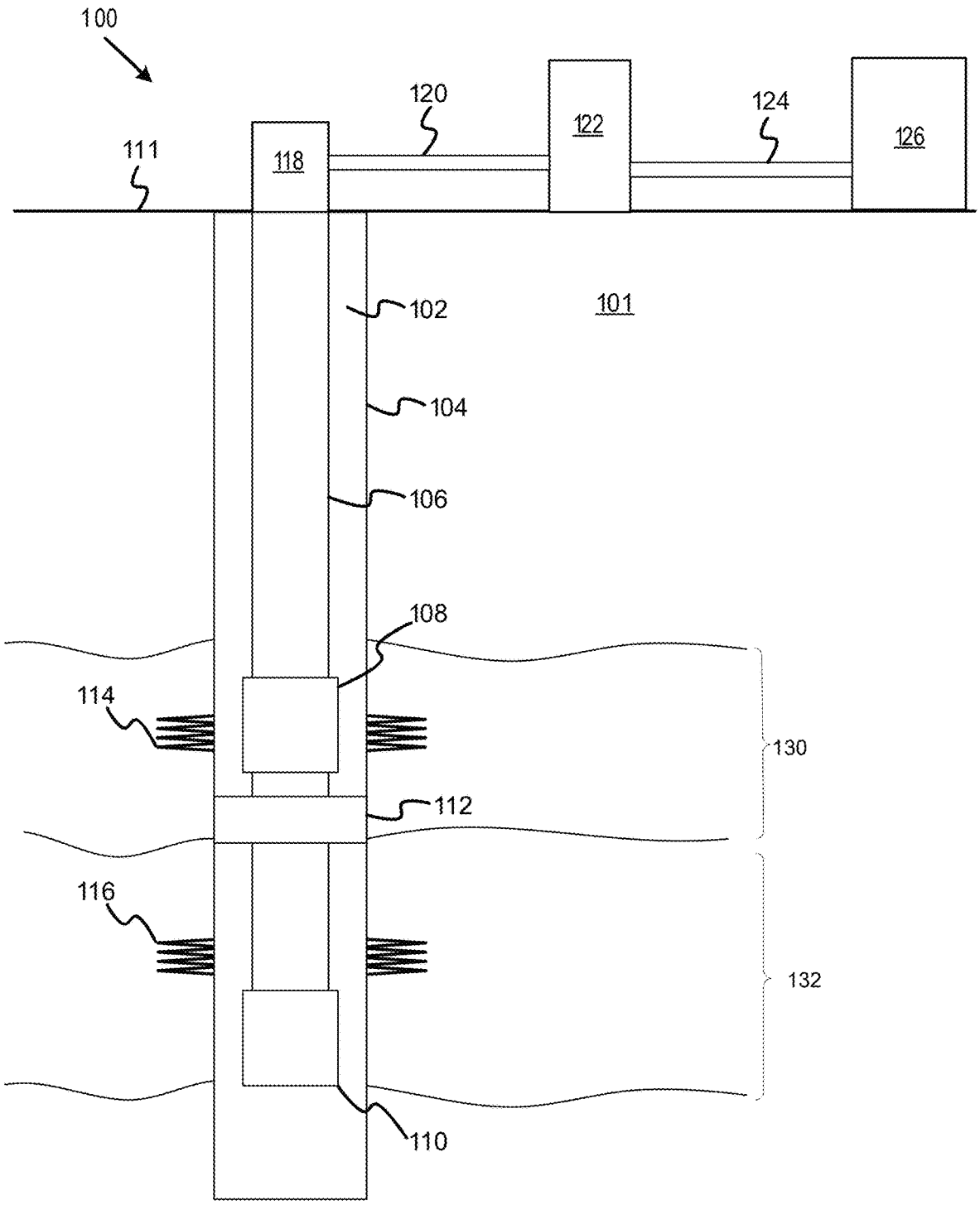
FIG. 1 is a schematic view of a section of an example well system, according to one or more embodiments disclosed herein.

The description that follows includes example systems, methods, techniques, and operational flows that embody aspects of the disclosure. However, this disclosure may be practiced without these specific details. For clarity, some well-known structures and techniques have been omitted.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom end of a well; likewise, use of the terms "down," "lower," "downward," "downhole," or other like terms shall be construed as generally toward the bottom end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

In some downhole environments, certain downhole tools, such as hydraulic set, hydrostatic assist, or control line set tools (for example, packers), need to be set with low supplied pressure. This could be because hydrostatic pressure at a setting depth is low, the surface system is not rated for a high pressure, or that other tools in the completion string will shear and actuate at a higher pressure which is unwanted.

Methods and tools disclosure herein include using a setting tool or ratcheting device including a resettable piston with differential areas, to actuate an actuable component for a downhole tool with low pressure cycles. No previous tools or methods are available that enable setting a packer or other tool with a plurality of pressure cycles as opposed to applying a pressure and then holding it for a defined period of time. The method and setting tool disclosed herein provide an improvement in pressure setting technologies, enabling packers and other pressure set tools to be set with almost any amount of supplied pressure. Alternatives for setting tools with low pressure amounts have heretofore included running multiple setting tools or adding multiple pistons on the packer in order to increase the setting force, but that becomes expensive and economically untenable. For example, if 2500 psi of pressure is needed to set a tool, 5 pistons each applying 500 psi may be required. The improvements provided by the disclosed embodiments alleviate the need for running setting tools, straddle tools, and/or multiple pistons, thereby saving rig length, time, and installation costs. The setting tool is described herein as a ratcheting device. Examples of the setting tool are shown herein with an activation chamber for a packer, but the setting tool/ratcheting device may be used with any actuable component including, but not limited to slips, sleeves, ball valves, pistons or other activating elements.

One skilled in the art will know that a device commonly known as a body lock ring may be needed to maintain the setting force and is not shown or described herein.

The setting tool/ratcheting device may include a resettable piston having areas at both ends of the piston and one or more check valves positioned between the piston and an activation chamber of the packer. A check valve is a non-limiting example of a device which may enable one way fluid flow. One skilled in the art will recognize that alternatives to check valves can include diaphragm valves, backflow preventers, non-return valves etc. Moreover, check valves themselves come in various types such as a swing check valve, ball check valve and poppet check valve. Any of these may be used to enable this disclosure. The piston is positioned in a piston chamber having area differentials between the areas at both ends of the piston. A low pressure amount applied at one end of the piston is intensified (similar to the principle for a hydraulic jack, i.e. Pascal's principle) due to the different piston areas on either end. A reset mechanism such as a mechanical spring, compressed gas, or compressible fluid may be used to reset the piston when pressure applied from the tubing is released or bled off. At least one check valve to annulus acts to balance pressure with the annulus while running in hole (RIH). During setting of a tool, a check valve adjacent the activation chamber may help retain the applied setting pressure, and after an applied pressure cycle, the at least one check valve to the annulus may help replenish the lost fluid.

Another alternative may include a rupture disk to prevent a setting force from being too high. Yet another alternative may include using a reservoir of clean, debris-free fluid instead of the setting tool taking in annular fluid.

Although the examples described and shown herein illustrate a resettable piston of a setting tool positioned at a downhole end of an activation chamber of a packer, the setting tool may also be positioned at an uphole end of an activation element of a downhole tool, such as with a control line set used with a feedthrough packer, or may be positioned at various positions along a packer. One skilled in the art will also recognize that the pressure may be supplied via the annulus instead of the tubing and the check valve may replenish fluid from the tubing instead. Alternatively, the pressure may be applied, and the check valve may face the same pressure source—either the tubing or annulus.

Examples disclosed herein may include a ratcheting device for use downhole in a wellbore. The ratcheting device may comprise a piston chamber coupled with an activation chamber and a resettable piston positioned in the piston chamber. The piston chamber may include a first portion having an area A at one end of the piston and adjacent to the activation chamber, and a second portion having an area larger than A, such as an area equal to at least a multiplier "x" times A. The second portion may be fluidly coupled with a pressure source for receiving pressure applied from a pressure source, such as from a source at the surface of the wellbore. The pressure source may be the tubing of the wellbore, the annulus of the wellbore, or a control line coupled either on the tubing or annulus side of the ratcheting device. A first pressure amount P applied into the second portion translates the resettable piston toward the activation chamber to increase the pressure in the first portion of the piston chamber by a second pressure amount equal to "x" times P. The pressure applied to the second portion may then be released or bled off, translating the piston back into the initial position. The pressure may be applied and released in multiple cycles until a total pressure amount is applied to the activation chamber to set the downhole tool. The value of multiplier x could be a whole number or not. For example, x may be 2 times, 3 times, 5 times, 5.62 times or any number thereof.

Benefits of the example setting tools/ratcheting device and method provided herein include a lesser cost of production as well as reduced pressure requirements which means lower cost surface systems such as pumps may be used. Cost is reduced because a high setting force can be obtained without stacking multiple pistons. Cost is also reduced because lower rated surface pressure equipment such as pumps may be used to actuate downhole tools.

An additional benefit may include preventing the need for including shear pins to control pressure while the tool may be run in hole and also to control a setting order of various components of a tool.

Example System

FIG. 1 illustrates an example well system for hydrocarbon reservoir production designed and manufactured according to one or more embodiments disclosed herein. FIG. 1 depicts a well system 100. While the well system 100 illustrates a land-based subterranean environment, the present disclosure contemplates any well site environment including a subsea environment. In one or more embodiments, any one or more components or elements may be used with subterranean operations equipment located on offshore platforms, drill ships, semi-submersibles, drilling barges and land-based rigs. Although the section shown in FIG. 1 is a vertical section, the examples discussed herein may be incorporated in various wellbore configurations.

In one or more embodiments, well system 100 includes a wellbore 102 in a subsurface formation 101. The wellbore 102 includes casing 104 and number of perforations 114, 116 being made in the casing 104. Each set of perforations 114, 116 is located in a respective reservoir 130, 132 to allow reservoir fluids (i.e., oil, water, and gas) from the respective reservoirs 130, 132 to flow into the wellbore 102 and into the tubular string 106 (the production tubing). The tubular string 106 includes at least one packer 112 that may prevent the comingling of fluids produced from the reservoirs 130, 132 in the wellbore 102. A production assembly 108 may allow the inflow of fluid produced from the reservoir 130 into the tubular string 106. Likewise, a production assembly 110 may allow the inflow of fluid produced from the reservoir 132 into the tubular string 106.

In some embodiments, the production assemblies 108, 110 may include one or more components requiring electric and or hydraulic power. The one or more components may include one or more valves, such as production valves, one or more interval control valves, ports, packers, sleeves, or other components which may be used to control flow into, or out of the well system 100, as well as lock and latch systems, packers, and flappers. The well system 100 may also include an actuator, such as a ratcheting device, for actuating the packer and the one or more components in the production assemblies 108, 110. The ratcheting device may be a hydraulic ratcheting device.

A flowline 120 coupled to wellhead 118 of wellbore 102 and a separator 122 may allow the fluid produced up the tubular string 106 to flow to the separator 122. The separator 122 may be designed to separate the phases of the fluid produced from the wellbore 102. For instance, oil, water, and gas may be separated from each other after passing through the separator 122. The aggregate of fluid produced from wellbore 102 may then flow to a tank battery, via flowline 124, that may include components such as storage tank 126, to store the produced fluid.

Figure 2:
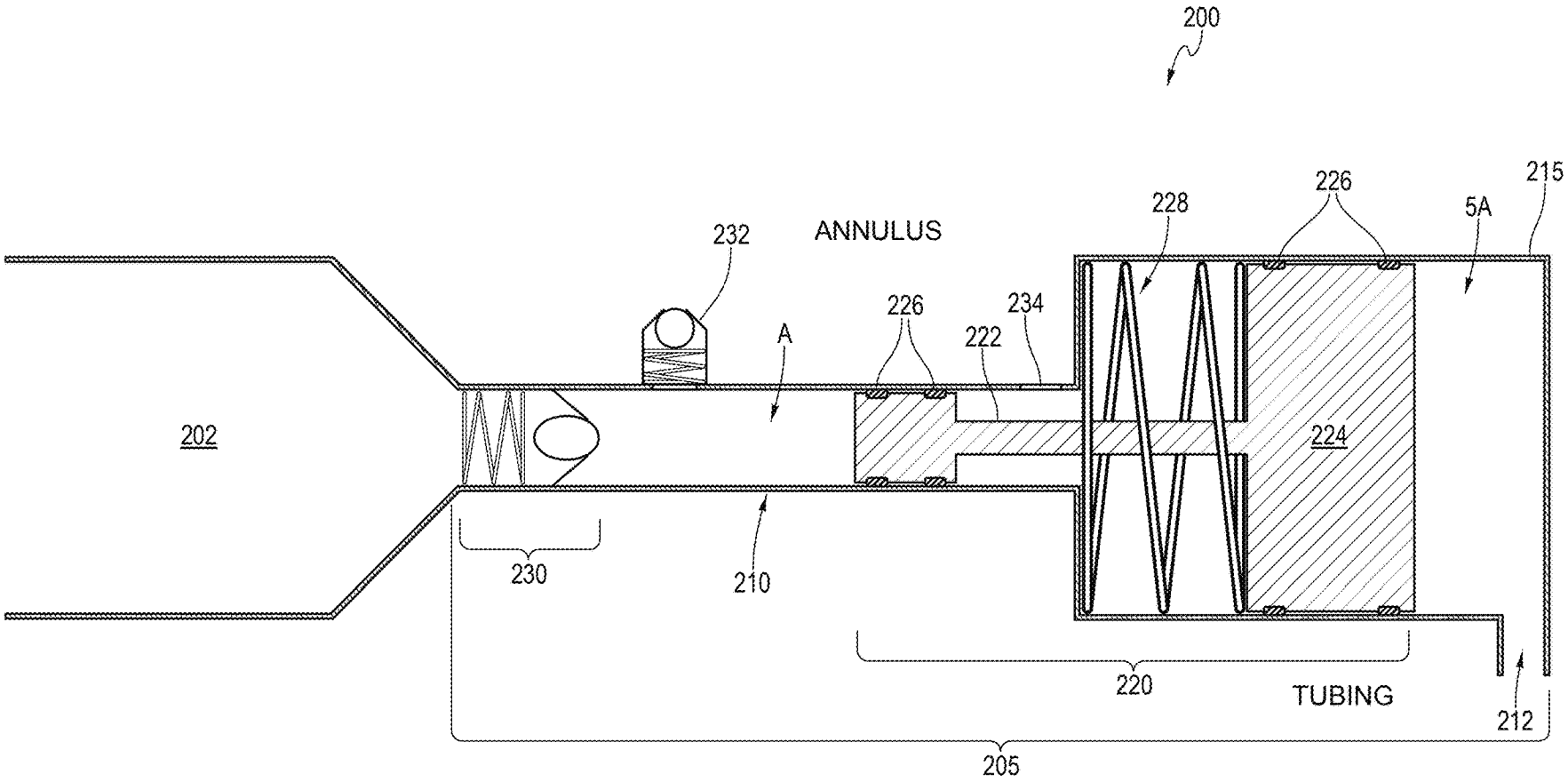
FIG. 2 is a diagram of an example ratcheting device in an initial, run in hole position, according to one or more embodiments disclosed herein.

Referring now to FIG. 2, there is shown an example setting tool. The setting tool may be a ratcheting device 200, which may be a hydraulic ratcheting device. The ratcheting device 200 is configured to be coupled adjacent an activation element or activation chamber 202 of a downhole tool. The ratcheting device 200 includes a resettable piston 220 positioned in a multi-area piston chamber 205 within a mandrel (not shown). The piston chamber 205 includes a first portion 210 and a second portion 215. The first portion 210 may also be referred to as the cycling chamber. The first portion 210 may be adjacent the activation chamber 202 and open to the wellbore annulus in at least one location. The second portion 215 may be open to the tubing of the wellbore via a port 212. The first portion 210 may be fluidly coupled, in this example, to annulus via at least a valve, such as check valve 232, and may also be open also via port 234. Alternatively, the first portion 210 may be opened to tubing and the second portion 215 open to annulus or they may both be opened to the same volume (tubing or annulus). Variations will be shown in FIGS. 7, 8, and 9. Each end of the piston 220 may include seals 226 to prevent fluid from passing across the piston 220, ensuring pressure builds up on one end of the piston 220 to create motion.

The piston chamber 205 is configured to create a pressure differential between the first portion 210 and the second portion 215. The first portion 210 has an area A and the second portion 215 has an area that is larger than A. As such, when a first amount of pressure P is applied to the second portion 215, pressure is increased in the first portion by an amount greater than P. In some examples, the differential may be at least a multiplier "x" times A. In this example, area A of the first portion 210 may be 1 square inch and the multiplier "x" is 5 such that the area of the second portion is 5 A and the pressure in increased in the first portion 210 by 5P.

FIG. 2 illustrates the setting tool at an initial, run-in-hole (RIH) operational configuration. A first check valve 230 may be positioned between the first portion 210 and the activation chamber and may be closed during RIH. The first check valve 230 is configured to allow a fluid to flow from the first portion 210 into the activation chamber 202. The second check valve 232 fluidly connects the first portion 210 with the annulus of the wellbore and may also be closed during RIH. The piston 220 may include a first end 222 extending into the first portion 210 and a second end 224 positioned within the second portion 215. A compressible energy source or reset mechanism may be positioned between the second end 224 of the piston 220 and the first portion 210. The reset mechanism in this example is a spring 228.

Figure 3:
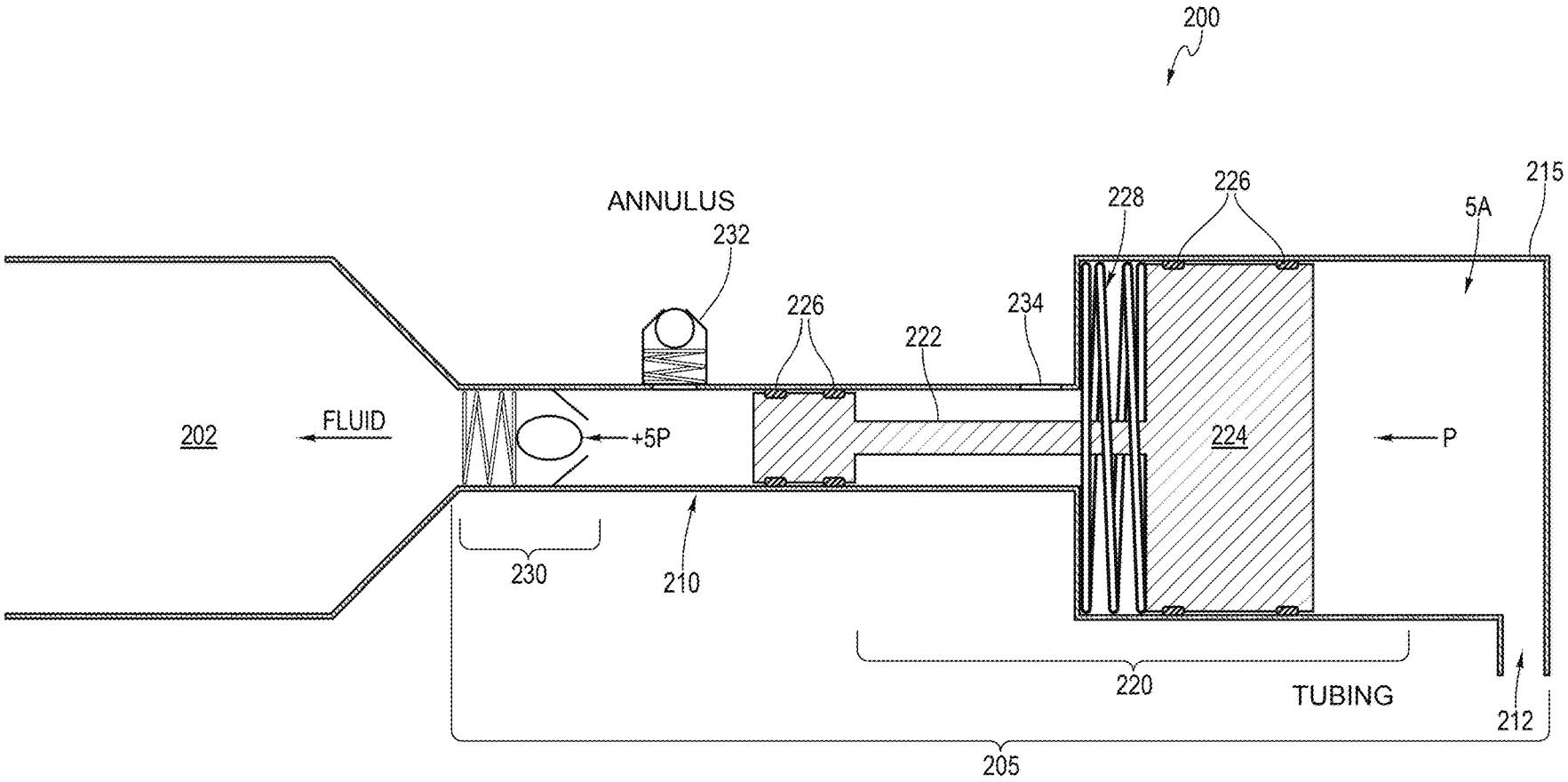
FIG. 3 illustrates the ratcheting device of FIG. 2 in a first operational position, according to one or more embodiments disclosed herein.
Figure 4:
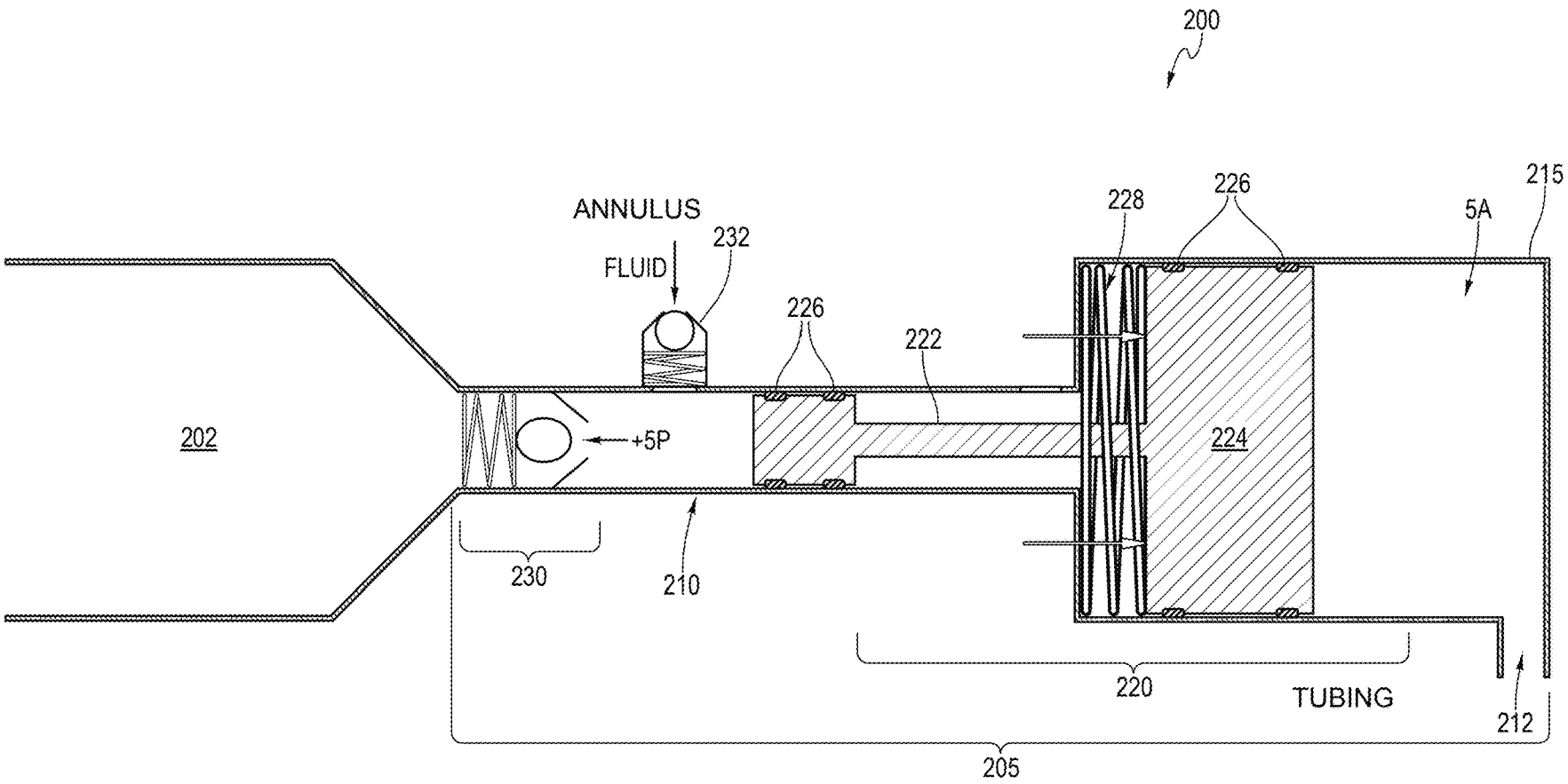
FIG. 4 illustrates the ratcheting device of FIG. 2 in a second operational position, according to one or more embodiments disclosed herein.
Figure 5:
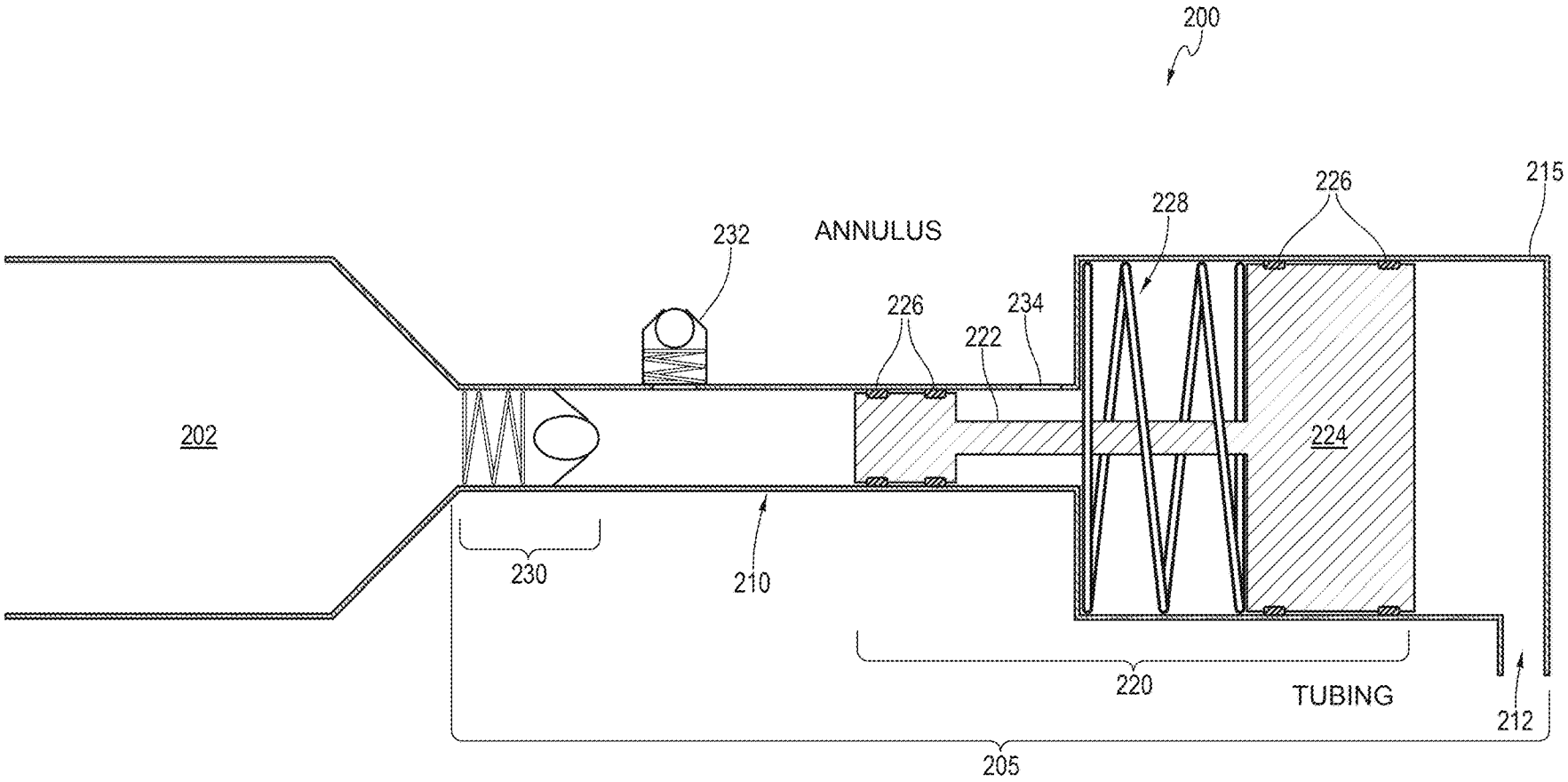
FIG. 5 illustrates the ratcheting device of FIG. 2 returned to an initial or run in hole operational position, according to one or more embodiments disclosed herein

Referring now to FIGS. 3-5, there is shown different operational stages of the ratcheting device 200 during application of pressure cycles. The ratcheting device/setting tool 200 is a pressure multiplier. Movement of the resettable piston 220 within the piston chamber 205 toward the activation chamber 202 pumps fluid into the activation chamber 202. The pressure is locked in using the first check valve 230 and second check valve 232. By varying and cycling the pressure applied to the piston chamber 205, a bicycle pump-like action is achieved thereby filling up the activation chamber 202. In this example, the area A may be 1 sq. in. and the multiplier "x" is 5. The area, pressure amounts, and example multipliers described are for exemplary purposes and not intended to be limiting—the area and pressure differential will vary based on the tool, location in the wellbore, pressure needed to set the tool, and other design factors such as cost, available diameter and other factors that may impact wellbore tool design.

As the ratcheting device 200 is run in hole, down a fluid column, a hydrostatic pressure will enter and be applied to the piston chamber 205 equalizing the pressure between check valves 230 and 232. Once the ratcheting device 200 reaches a desired depth in the wellbore, a first amount of pressure P is applied to the ratcheting device 200. In this example, pressure is applied to the tubing from the surface of the wellbore, which is then applied to the second portion 215 of piston chamber 205 via port 212. The pressure P acts on the resettable piston 220, translating the resettable piston 220 toward the activation chamber 202, compressing the spring 228, and causing an increase of pressure in the first portion 210 of the piston chamber between the piston 220 and the first check valve 230. The second pressure amount will be greater than P, and in some examples may be equal to the multiplier "x" times P. The multiplier "x" may apply for the differential of both the area A between the first portion 210 and second portion 215 and also the pressure amount P per Pascal's law. The pressure and area differential may be designed for a setting tool based on amount of space and location in the wellbore as well as a total amount of pressure needed to set the downhole tool. The first check valve 230 opens in response to the increase in pressure to allow fluid to flow into the activation chamber 202.

In one example, the pressure in the first portion 210 may be equal to annulus once the ratcheting device is at the desired depth in the wellbore. A first amount of pressure P, in this example 500 psi hydrostatic pressure, is applied from the tubing. The first amount of pressure P acts on the piston 220, translating the piston 220 toward the activation chamber 202. As the piston 220 translates, the area differential between the first portion 210 and second portion 215 causes an increase in pressure in the first portion 210 by a an amount greater than P. If the multiplier x=5, then the pressure increases by 2500 psi (500 psi, P, times 5). The force generated in the first portion 210 and acting on the check valve 230 is therefore 2,500 lbf (500 psi×5 sq. in area). This closes the second check valve 232 to the annulus and opens the first check valve 230 to the activation chamber 202 thereby pumping fluid into the activation chamber 202.

Referring now to FIG. 4, there is shown the ratcheting device 200 in an operational stage as pressure P applied to the second portion is released. When the 500 psi is released, the remaining pressure in the first portion 210 between first end 222 and check valve 230 combine with spring 228 to translate the piston 220 away from the activation chamber 202 toward the initial state shown in FIG. 2. Fluid and pressure may be drawn into the first portion 210 through the second check valve 232 and may allow annulus fluid to enter and fill up the first portion 210 of the piston chamber 205 to replenish the fluid that was lost to the activation chamber 202.

Referring to FIG. 5, there is shown the setting tool in an operational state after the pressure P has been released. The resettable piston is back at or near the initial RIH position. Another cycle of applying pressure and releasing pressure may be repeated until enough fluid is built up in the activation chamber so that a total pressure is available to set the downhole tool.

The disclosed pressure cycle operations are repeated a plurality of times. By repeating this operational sequence over several cycles, fluid may be pumped into the activation chamber 202 and build up enough pressure differential over hydrostatic pressure inside the activation chamber 202 in order to set an element of the packer. The pressure P applied in this example is applied from the surface to the tubing. In other examples, the pressure P may be applied to the annulus or via a control line.

Figure 6:
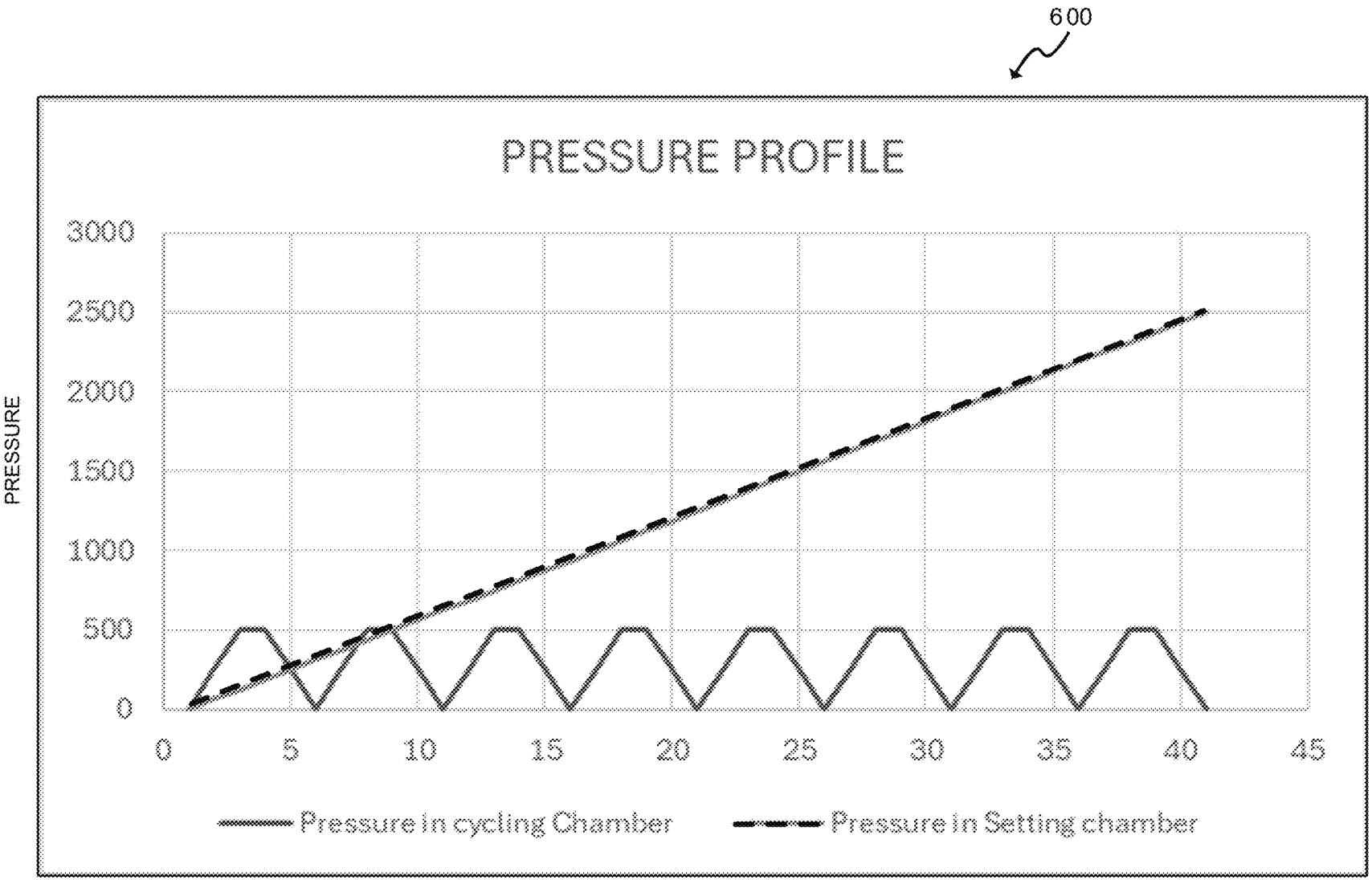
FIG. 6 is a chart illustrating pressure cycles applied by a ratcheting device, according to one or more embodiments disclosed herein.

Referring now to FIG. 6, there is a graph 600 illustrating an example pressure profile created by applying low amounts of pressure in cycles as described herein. Pressure applied in the second portion 215 is shown versus the cumulative pressure applied into the first portion. The x-axis represents time and the y-axis represents pressure.

FIGS. 7-11 illustrate additional example ratcheting devices. Similar to ratcheting device 200, each example includes a piston chamber having an area differential between the first and second portions of the piston chamber, such as, for example, A and 5 A. As will be shown, there may be variations of placement of the openings to annulus, tubing, and various reset mechanisms. In addition to the examples shown, Table 1 also provides different example configurations.

TABLE 1

| Check Valve (Example 232) | Port into first portion of the piston chamber (Example 234) | Reset Mechanism (Example 228) | Port into second portion of the piston chamber (Example 212) |
|---|---|---|---|
| Open to annulus | Open to annulus | Spring | Open to tubing |
| Open to annulus | Absent (no port) | Any-spring, gas, Belleville spacer | Open to tubing |
| Open to Tubing | Open to Tubing | Spring | Open to annulus |
| Open to Tubing | Absent (no port) | Any-spring, gas, spacer | Open to annulus |

Figure 7:
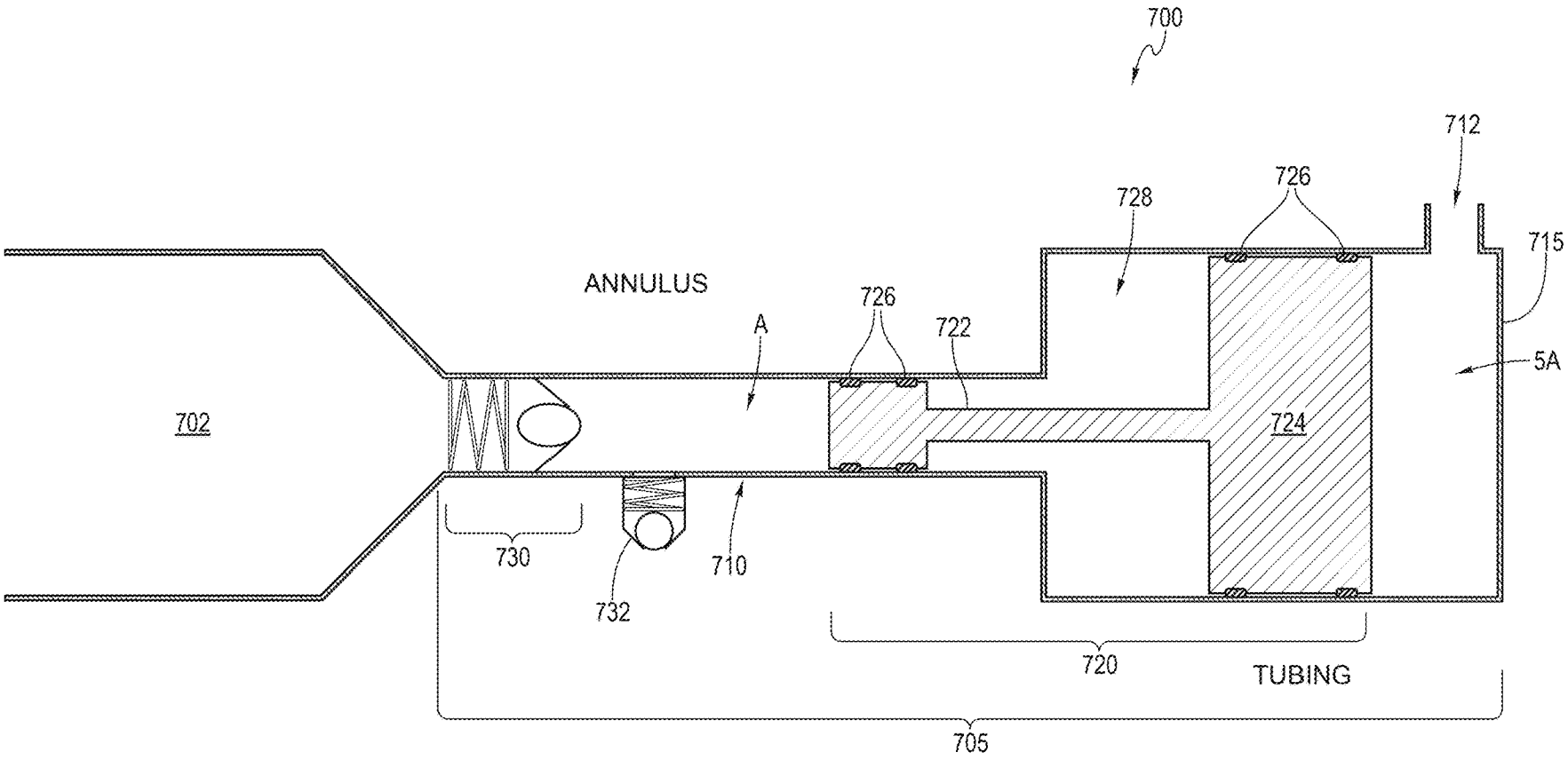
FIG. 7 is a diagram of another example ratcheting device, according to one or more embodiments disclosed herein.

Referring now to FIG. 7, there is shown another embodiment of a ratcheting device 700. Ratcheting device 700 is similar to ratcheting device 200 shown and described above and similar reference numbers are used to describe similar features. A resettable piston 720 may include a first end 722 extending into the first portion 710 and a second end 724 positioned within the second portion 715. In this example, the reset mechanism to reset piston 720 may be a volume of compressible gas 728. The piston 720 includes seals 726 which help maintain the gas and prevent fluid or air from passing across the piston 720. Positively biased pressure on the activation chamber 702 may be maintained by first check valve 730, while fluid and pressure may be bled into the annulus by second check valve 732 when pressure is released and the resettable piston 720 translates back to at or near an initial RIH position. In this example, check valve 732 may face the tubing and port 712 is open to annulus.

Figure 8:
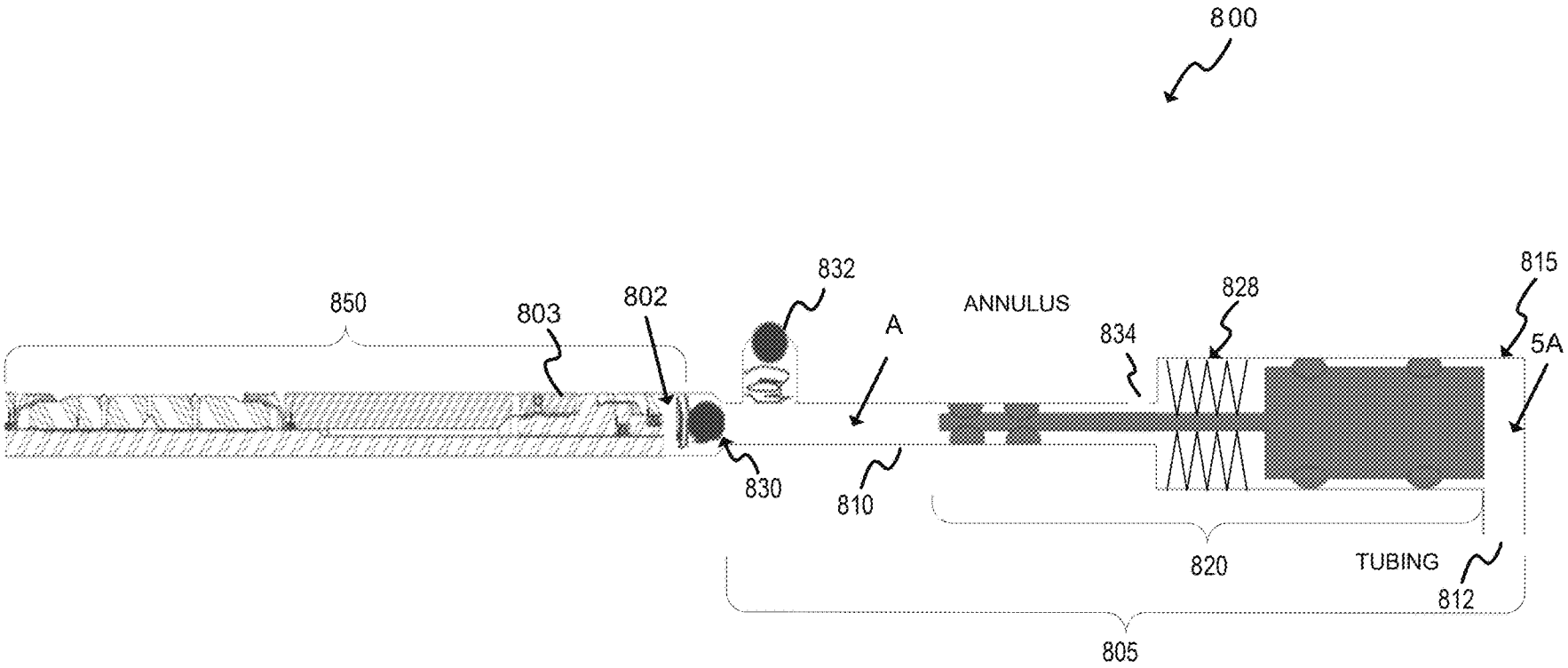
FIG. 8 is a diagram of yet another example ratcheting device, according to one or more embodiments disclosed herein.

Referring now to FIG. 8, there is shown another embodiment of a ratcheting device 800. Ratcheting device 800 is similar to ratcheting device 200 shown and described above and similar reference numbers are used to describe similar features. In this example, a first portion 810 of piston chamber 805 includes an opening 834 to annulus, and a second portion 815 is open to the tubing via opening or port 812. The reset mechanism to reset a resettable piston 820 may be a spring or other means of energy storage and release such as Belleville spacers 828. The piston 820 includes seals 826 prevent fluid or air from passing across the piston 820. Positively biased pressure on the activation chamber 802 of packer 850 is locked in by first check valve 830, while fluid may be replenished from the annulus by second check valve 832. One skilled in the art will recognize that such an arrangement stores the multiplied pressure (in this example 2,500 psi) permanently inside activation chamber 802. In instances where a packer element may contract due to a reduction in downhole temperature, the element may otherwise lose contact pressure with the casing or wellbore but with this embodiment, the stored pressure of 2,500 psi may now push the piston 803 further and impart more squeeze to the element. One skilled in the art may recognize that piston 803 may have a lock ring that allows it to ratchet to the left (in the diagram as shown) but not to the right. This will permanently lock in this extra setting force that is imparted to the element during the thermal cool down. One skilled in the art will also recognize that using a lock ring as described will prevent this trapped pressure from spiking to an unacceptably high level when the element sees differential pressure (in this case from above).

Figure 9:
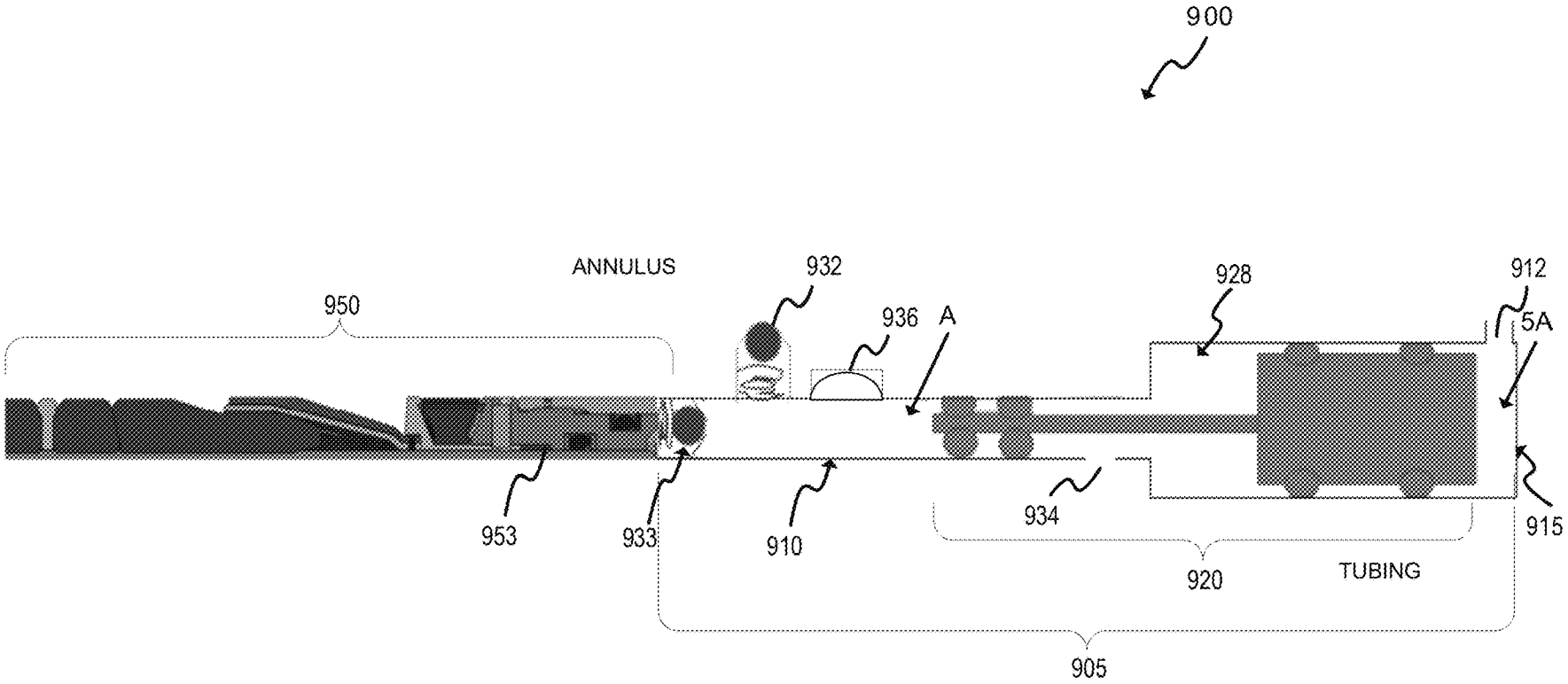
FIG. 9 is a diagram of another example ratcheting device, according to one or more embodiments disclosed herein.

Referring now to FIG. 9, there is shown another embodiment of a ratcheting device 900. Ratcheting device 900 is similar to ratcheting device 200 shown and described above and similar reference numbers are used to describe similar features. In this example, the reset mechanism to reset a resettable piston 920 may be a spring (not shown) similar to spring 228 in FIG. 2. The piston 920 includes seals 926 which help maintain the gas and prevent fluid or air from passing across the piston 920. Positively biased pressure on the setting chamber of packer 950 is locked in. A setting force may be applied during pressure below and cooling down to fight thermal contraction of the packer 950 setting chamber. The first portion 910 of piston chamber 905 may also include a rupture disk 936 set at a limiting pressure so that high pressures applied from the tubing do not get multiplied. Instead, the high pressures will rupture the rupture disk 936 and defeat the "bike pump" ratcheting device as fluid would just vent in and out of the annulus when the resettable piston 920 is activated. In some examples, instead of the rupture disk 936, a relief valve may also be used, so pressures exceeding the relief valve value get vented into annulus but pressures within a safe limit may translate to the activation chamber 902. One skilled in the art will recognize that with this arrangement, piston 953 is pressure balanced with the annulus as it is exposed to annulus pressure directly on its left (uphole as illustrated) and indirectly to its right (downhole as illustrated) via the check valves 932 and 933.

In this example, the second portion 915 is open to the annulus via port 912 and pressure applied from the surface is applied through the annulus to the ratcheting device 900. The first portion 910 is open to tubing via port 934.

Figure 10:
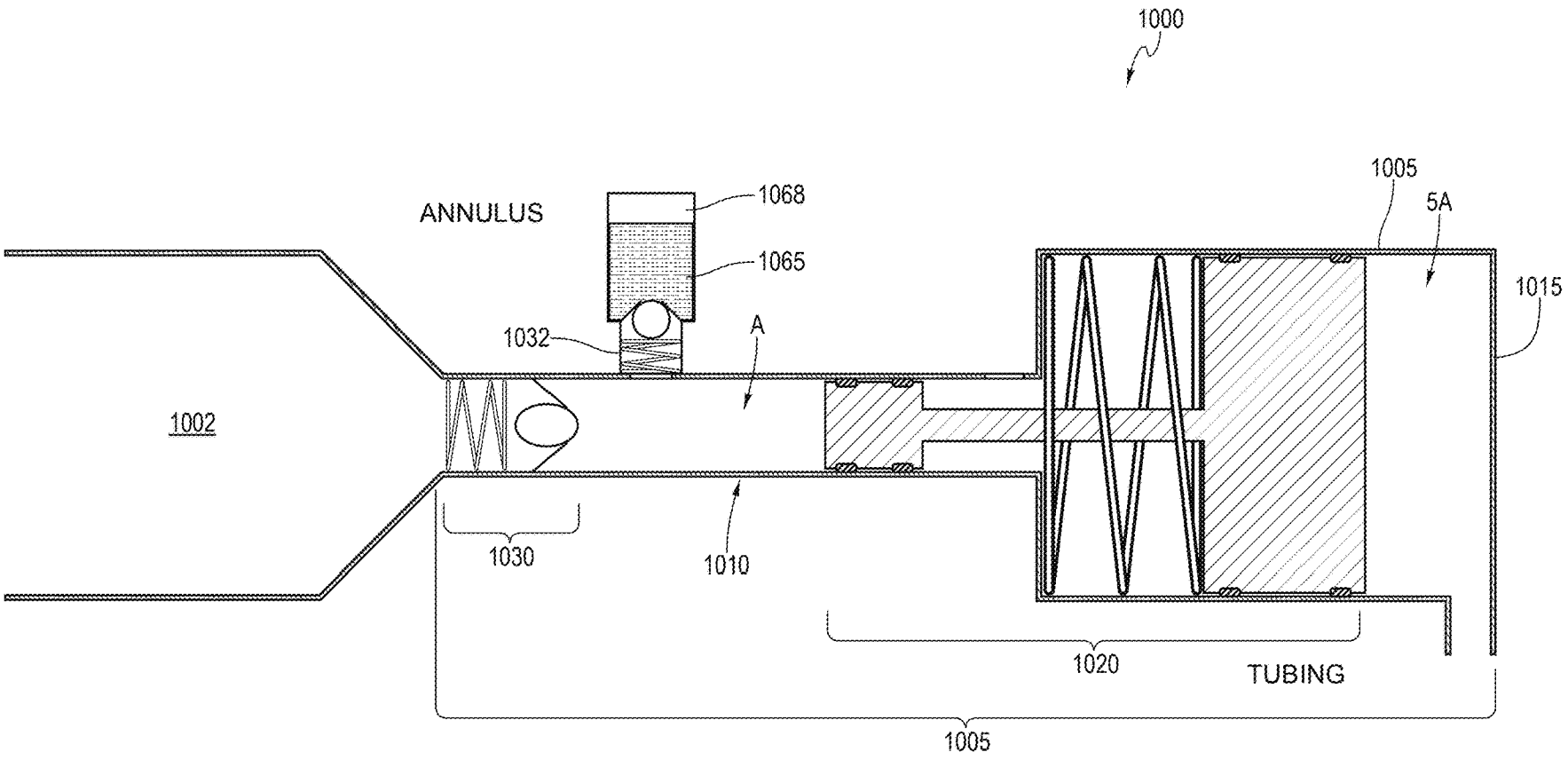
FIG. 10 is a diagram of yet another example ratcheting device, according to one or more embodiments disclosed herein.

Referring now to FIG. 10, there is shown another embodiment of a ratcheting device 1000. Ratcheting device 1000 is similar to ratcheting device 200 shown and described above and similar reference numbers are used to describe similar features. In this example, the piston chamber 1005 includes a second check valve 1032 coupled with a clean fluid chamber 1065. The ratcheting device 1000 uses a clean fluid chamber equalized with annulus pressure instead of exposing a first portion 1010 of the piston chamber 1005 and a resettable piston 1020 to annulus or tubing directly. This prevents any scope of debris from clogging the check valves, first check valve 1030 and second check valve 1032. The clean fluid chamber 1065 includes a pressure compensating device, in this example piston 1068, exposed to annulus or tubing pressure. The pressure compensating device may also be any other pressure compensating devices such as a diaphragm, bellow or others without departing from the scope of the invention.

Figure 11:
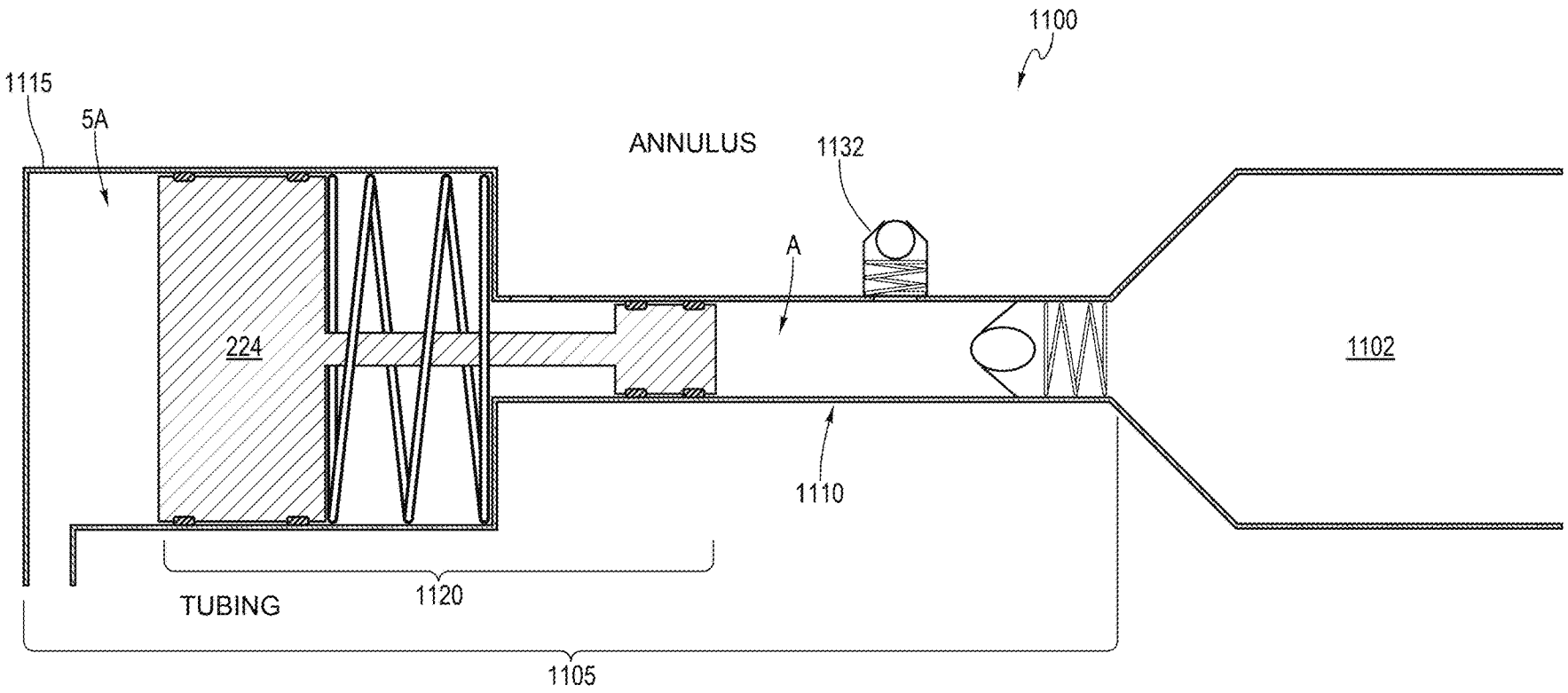
FIG. 11 is a diagram of another example ratcheting device, according to one or more embodiments disclosed herein.

Referring now to FIG. 11, there is shown an example ratcheting device 1100. In this example, a piston chamber 1105 and piston 1120 are coupled uphole of an activation chamber 1102. In this example, second portion 1115 is shown open to the tubing, but in other examples, the second portion may be open to annulus. In this example, the first portion 1110 is only fluidly coupled to annulus via second check valve 1132.

Figure 12:
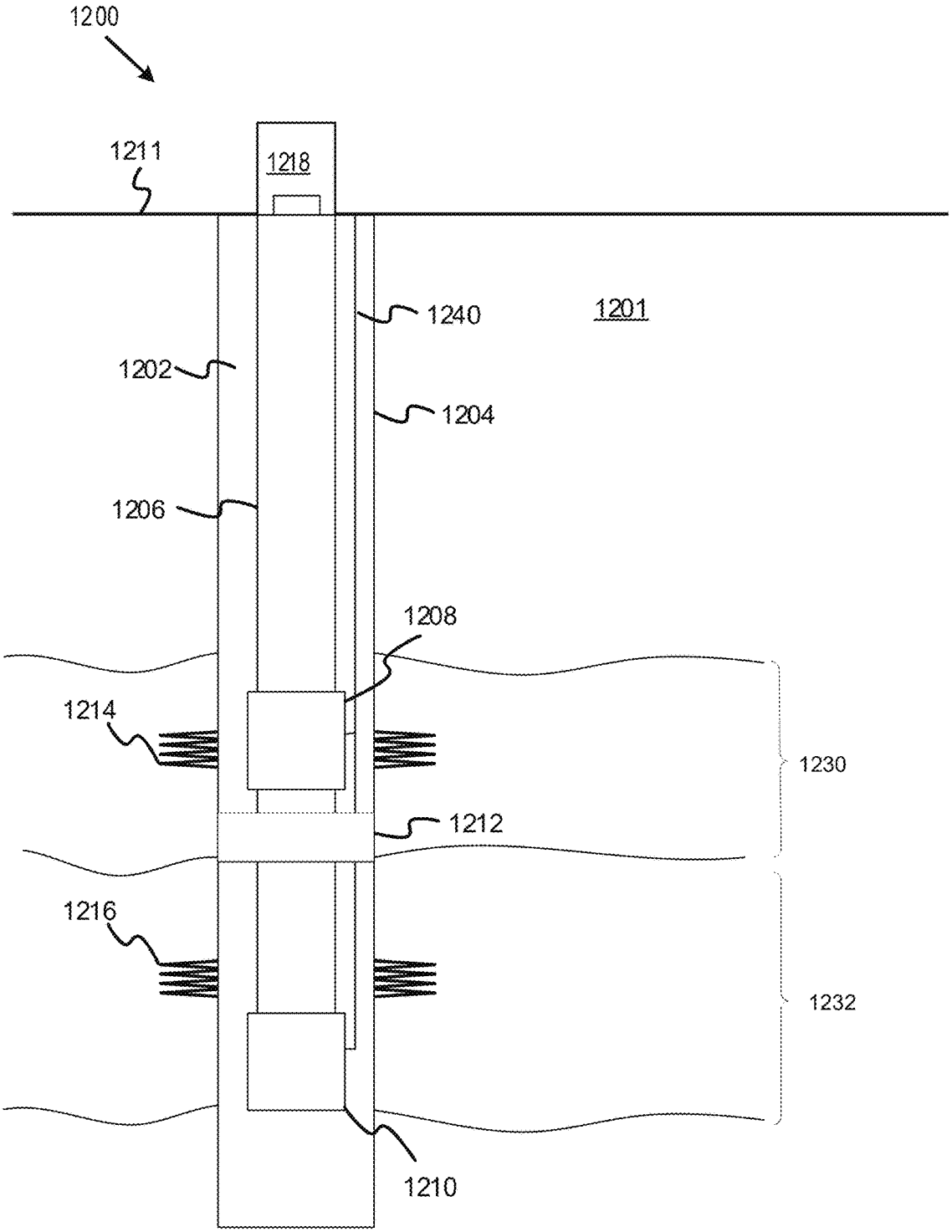
FIG. 12 is another example well system, according to one or more embodiments disclosed herein, wherein the well system employes a control line to apply pressure from the surface to one or more downhole components.

FIG. 12 illustrates another example well system for hydrocarbon reservoir production designed and manufactured according to one or more embodiments disclosed herein. In one or more embodiments, well system 1200 includes a wellbore 1202 in a subsurface formation 1201 and a wellhead 1218 positioned at the surface of the wellbore 1202. The wellbore 1202 includes casing 1204 and number of perforations 1214, 1216 being made in the casing 1204 and located in a respective reservoirs 1230, 1232. The tubular string 1206 includes at least one downhole tool that may be actuated by pressure.

In some embodiments, the production assemblies 1208, 1210 may include one or more components requiring electric and or hydraulic power. The one or more components may include one or more valves, such as production valves, one or more interval control valves, ports, packers, sleeves, or other components which may be used to control flow into, or out of the well system 1200, as well as lock and latch systems, packers, and flappers. The well system 1200 may also include an actuator, such as a ratcheting device, for actuating a downhole tool, such as a packer, and one or more components in the production assemblies 1208, 1210. The ratcheting device may be a hydraulic ratcheting device. FIG. 12 depicts a well system 1200 which may include a control line 1240 for applying pressure to a ratcheting device, such as ratcheting device 200. The control line 1240 may be connected with either the annulus or tubing side of the ratcheting device, similar to how pressure may be applied through either the tubing or annulus in the examples herein.

Example Methods

Figure 13:
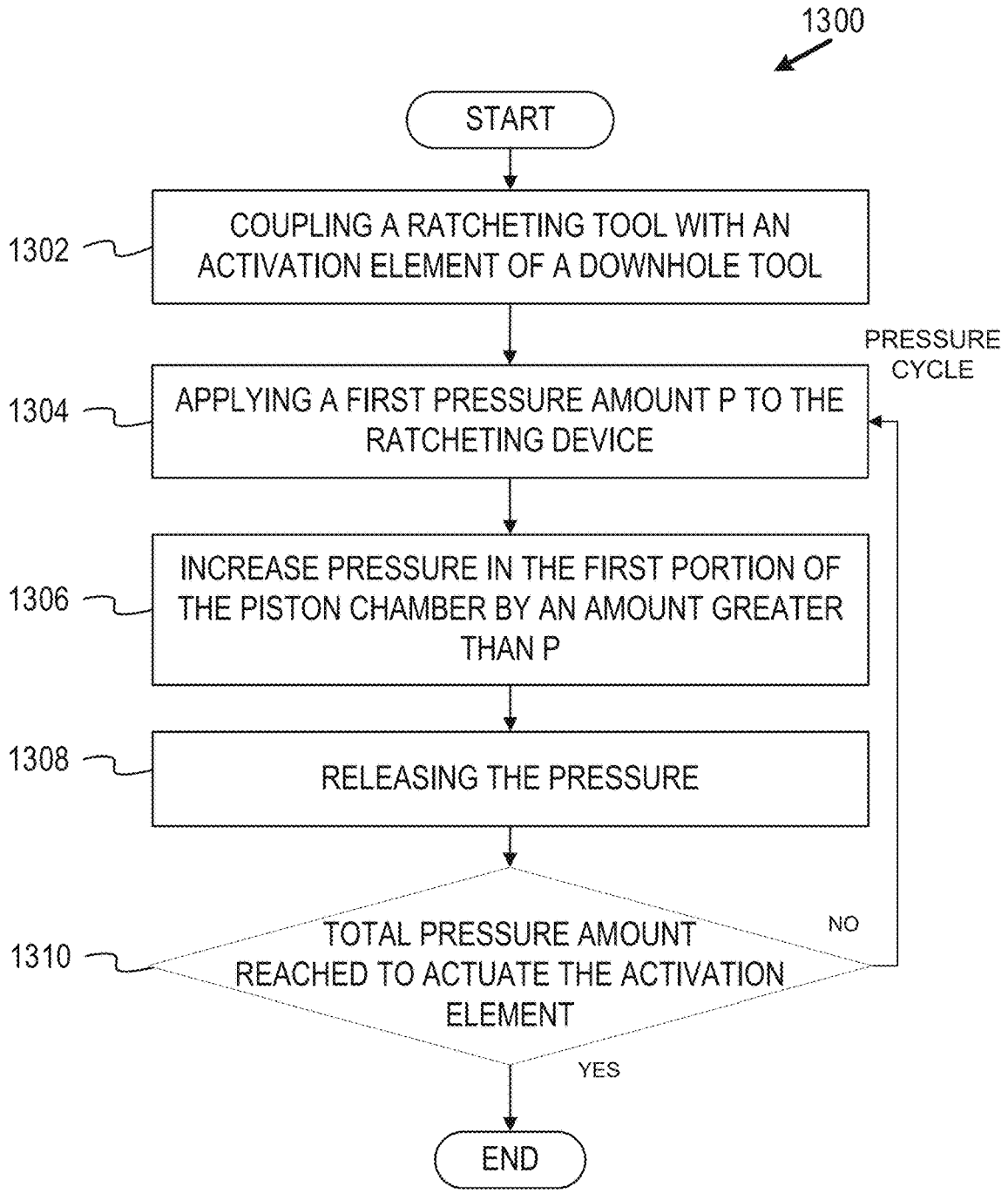
FIG. 13 is a flowchart depicting another method, according to one or more embodiments disclosed herein.

FIG. 13 is a flowchart illustrating example operations for setting a downhole tool according to one or more embodiments disclosed herein. In particular, FIG. 13 is a flowchart of a method 1300 showing one embodiment for using a setting tool, such as ratcheting device shown in FIGS. 2-12 to actuate a downhole tool using a plurality of pressure cycles.

The method begins at a block 1302, coupling a ratcheting tool with an activation chamber or element of a downhole tool that is set by one of hydraulic pressure, hydrostatic assist, or set by pressure applied by a control line. The setting tool may be any of the ratcheting devices as shown and described in FIGS. 2-11. The ratcheting tool may be a separate subassembly which may be coupled to any number of downhole tools. Or in some implementations, the ratcheting tool may be integrated into the downhole tool being activated.

The method continues in a block 1304, applying pressure from the surface of the wellbore to the ratcheting device. The pressure may be applied through the tubing of the wellbore, through the annulus of the wellbore, or by a control line from the surface. The pressure applied is a first pressure amount P.

At a block 1306, as the first amount of pressure P is applied to a second portion of a piston chamber, the pressure amount P acts on a resettable piston to translate the resettable piston from an initial RIH position toward the activation element. The pressure applied may be in the form of fluid from hydrostatic pressure in the wellbore tubing or annulus or by application from a control line. As the resettable piston translates toward the activation element, pressure increases in the first portion of the piston chamber by an amount of pressure greater than P. In some examples, the pressure increase may be equal to a multiplier "x" times P. In the described embodiments, the multiplier is 5. The pressure increase, "x" times P, in the first portion, acts on a first check valve coupled with the activation chamber to introduce the increased pressure into the activation chamber.

The method continues in a block 1308, releasing the applied pressure from the second portion of the piston chamber. Upon release of tubing pressure, a reset mechanism, such as a spring or compressed gas, will translate the resettable piston back toward the initial position, closing the first check valve and causing the second check valve to open and replenish fluid in the first portion of the piston chamber.

At a block 1310, a determination is made whether or not a total pressure has accumulated in the activation chamber to activate and set the downhole tool. If the total pressure amount to set the downhole tool is not yet reached, the method returns to block 1304 and the pressure cycle operations of blocks 1304 and 1308 are repeated until the total pressure amount is reached in the activation chamber to actuate the downhole tool. In some examples, a pressure sensor may be integrated into the tool to measure the total pressure amount.

The number of cycles for the pressure operations will be determined by the size of the device and the activation element to set the device. Once the activation element is actuated by the pressure, the method ends.

The setting tool and method as disclosed herein may eliminate the need for a slickline/rig crew as surface pressure will suffice for providing the pressure into the piston chamber.

The above disclosed system and methods may be used with any downhole tool that may be actuated using hydraulic pressure or hydrostatic assist. While the examples are provided to packers, the ratcheting device may be used in combination with any downhole actuable element or activation element of a tool such as but not limited to a sleeve, ball valve, inflatable packer and so on.

As used herein, the term "or" is inclusive unless otherwise explicitly noted. Thus, the phrase "at least one of A, B, or C" is satisfied by any element from the set {A, B, C} or any combination thereof, including multiples of any element.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, and the principles and the novel features disclosed herein.

The various implementations may include some implementations that have all or any combination of the aspects described herein. An implementation can include any one or more of the aspects described herein. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations.

In certain circumstances, multitasking and parallel processing may be advantageous. Additionally, other implementations are within the scope of the following claims. In some cases, the actions recited in the claims may be performed in a different order and still achieve desirable results.

EXAMPLE EMBODIMENTS

Aspects disclosed herein include:

Aspect A: A setting tool for use downhole in a wellbore, the setting tool comprising: a piston chamber configured to be coupled with an activation chamber of a downhole tool; and a resettable piston positioned in the piston chamber; wherein the piston chamber comprises at least, a first portion having an area A adjacent to the activation chamber, and a second portion having an area larger than the first portion, wherein a first pressure amount P applied from the surface of the wellbore into the second portion translates the resettable piston toward the activation chamber to increase pressure in the first portion by an amount larger than P.

Aspect B: A system for use in a wellbore, comprising; a downhole tool having an activation chamber; and a setting tool coupled with the downhole tool, the setting tool comprising, a piston chamber coupled with an activation chamber; and a resettable piston positioned in the piston chamber; wherein the piston chamber comprises at least, a first portion having an area A adjacent to the activation chamber, and a second portion having an area larger than the first portion, and wherein a first pressure amount P applied from the surface into the second portion translates the resettable piston toward the activation chamber to increase pressure in the first portion by an amount larger than P.

Aspect C: A method for setting a downhole tool in a wellbore, the method comprising: coupling a setting tool with an activation element of the downhole tool, the setting tool comprising: a piston chamber coupled with the activation element; and a resettable piston positioned in the piston chamber; wherein the piston chamber comprises at least, a first portion having an area A adjacent to the activation element, and a second portion having an area larger than the first portion; and applying a pressure cycle from the surface of the wellbore, wherein each pressure cycle includes, applying a pressure amount P into the second portion, translating the resettable piston toward the activation element to increase pressure in the first portion by an amount larger than P, and releasing the pressure amount P; repeating applying the pressure cycle until a required total pressure amount is applied to the activation element to set the downhole tool.

Aspects A, B, and C may have one or more of the following additional elements in combination:

Element 1: further comprising a first check valve between the piston chamber and the activation chamber.

Element 2: further comprising a second check valve which fluidly couples the first portion of the piston chamber with one of an annulus of the wellbore or tubing of the wellbore.

Element 3: further comprising a clean fluid chamber coupled with the second check valve.

Element 4: wherein the second portion of the piston chamber is open to one of tubing of the wellbore or the wellbore annulus.

Element 5: further comprising a compressible energy source to translate the resettable piston away from the activation chamber in response to a releasing the first pressure amount P applied.

Element 6: wherein the compressible energy source is one of a mechanical spring or a compressible gas.

Element 7: wherein the second portion of the piston chamber is coupled with a control line.

Element 8: wherein the downhole tool may be set by one of hydraulic pressure, hydrostatic assist, or by a control line.

Element 9: the system further comprising: a first check valve between the piston chamber and the activation chamber; and a second check valve in the first portion of the piston chamber, wherein the second check valve is fluidly coupled with one of an annulus of the wellbore or tubing of the wellbore.

Element 10: further comprising a fluid chamber coupled with the second check valve.

Element 11: further comprising a compressible energy source to translate the resettable piston away from the activation chamber in response to a releasing the first pressure amount P applied.

Element 12: wherein the second portion of the piston chamber is open to one of tubing of the wellbore or the wellbore annulus.

Element 13: further comprising a second check valve opening the piston chamber to one of the wellbore annulus or tubing, and a compressible energy source positioned between a second end of the resettable piston and the first portion of the piston chamber.

Element 14: wherein the second check valve is configured to allow replenish fluid into the first portion of the piston chamber as a compressible energy source acts upon the piston in response to releasing the pressure.

Element 15: wherein the pressure is applied from the surface of the wellbore through one of an annulus of the wellbore or wellbore tubing.

Element 15: wherein the pressure is applied from the surface of the wellbore via a control line.

What is claimed is:

1. A setting tool for use downhole in a wellbore, the setting tool comprising:

a piston chamber configured to be coupled with an activation chamber of a downhole tool; and a resettable piston positioned in the piston chamber;

wherein the piston chamber includes:

a first portion having a cross-sectional area A, the first portion adjacent to the activation chamber;

a second portion having a cross-sectional area larger than A, the second portion having a port with a first fluid source;

a first check valve fluidly coupling the piston chamber to the activation chamber, the first check valve configured to direct fluid from the first portion into the activation chamber when pressure in the first portion rises above a first threshold; and a second check valve fluidly coupling the first portion to a second fluid source, the second check valve configured to direct fluid from the second fluid source into the first portion when pressure in the first portion falls below a second threshold;

wherein a first pressure amount P is applied to the second portion, wherein the first pressure amount P translates the resettable piston toward the activation chamber, increasing pressure in the first portion by an amount larger than P.

2. The setting tool according to claim 1, wherein the second check valve fluidly couples the first portion of the piston chamber with one of an annulus of the wellbore or tubing of the wellbore.

3. The setting tool according to claim 1, wherein the second fluid source is a clean fluid chamber coupled with the second check valve.

4. The setting tool according to claim 1, wherein the second portion of the piston chamber is open to one of tubing of the wellbore or an annulus of the wellbore.

5. The setting tool according to claim 1, wherein the resettable piston includes a compressible energy source, the compressible energy source, when compressed, acting to push the resettable piston away from the activation chamber.

6. The setting tool according to claim 5, wherein the compressible energy source is one of a mechanical spring or a compressible gas.

7. The setting tool according to claim 1, wherein the second portion of the piston chamber is coupled with a control line, the control line, when active, applying the first pressure amount P to the resettable piston.

8. The setting tool of claim 1, wherein the first and second fluid sources are different fluid sources.

9. A system for use in a wellbore, comprising;

a downhole tool having an activation chamber; and a setting tool coupled with the downhole tool, the setting tool comprising:

a piston chamber coupled with an activation chamber; and a resettable piston positioned in the piston chamber;

wherein the piston chamber includes:

a first portion having a cross-sectional area A, the first portion adjacent to the activation chamber;

a second portion having a cross-sectional area larger than A, the second portion having a port with a first fluid source;

a first check valve fluidly coupling the piston chamber to the activation chamber, the first check valve configured to direct fluid from the first portion into the activation chamber when pressure in the first portion rises above a first threshold; and a second check valve fluidly coupling the first portion to a second fluid source, the second check valve configured to direct fluid from the second fluid source into the first portion when pressure in the first portion falls below a second threshold, wherein the first and second fluid sources are different fluid sources;

wherein a first pressure amount P is applied to the second portion, wherein the first pressure amount P translates the resettable piston toward the activation chamber, increasing pressure in the first portion by an amount larger than P.

10. The system according to claim 9, wherein the downhole tool may be configured to be set by one of hydraulic pressure, hydrostatic assist, or by a control line.

11. The system according to claim 9, wherein the second check valve fluidly couples the first portion of the piston chamber with one of an annulus of the wellbore or tubing of the wellbore.

12. The system according to claim 11, wherein the second fluid source is a clean fluid chamber coupled with the second check valve.

13. The system according to claim 9, further comprising a compressible energy source, the compressible energy source, when compressed, acting to push the resettable piston away from the activation chamber.

14. The system according to claim 9, wherein the second portion of the piston chamber is open to one of tubing of the wellbore or an annulus the wellbore.

15. A method for setting a downhole tool in a wellbore, the method comprising:

coupling a setting tool with an activation element of the downhole tool, the setting tool comprising:

a piston chamber coupled with the activation element; and a resettable piston positioned in the piston chamber;

wherein the piston chamber includes:

a first portion having a cross-sectional area A, the first portion adjacent to the activation element;

a second portion having a cross-sectional area larger than A, the second portion having a port with a first fluid source;

a first check valve fluidly coupling the piston chamber to the activation chamber; and a second check valve fluidly coupling the first portion to a second fluid source, wherein the first and second fluid sources are different fluid sources;

applying a plurality of pressure cycles to the resettable piston through the port of the second portion, wherein each pressure cycle includes:

applying a pressure amount P to the resettable piston in the second portion, pushing the resettable piston toward the activation element, the pushing increasing pressure in the first portion by an amount larger than P;

directing fluid from the first portion through the first check valve into the activation chamber when pressure in the first portion rises above a first threshold;

releasing the pressure amount P;

pushing the resettable piston away from the activation element; and directing fluid from the second fluid source into the first portion when pressure in the first portion falls below a second threshold; and repeatedly applying the pressure cycle until the activation element sets the downhole tool.

16. The method according to claim 15, wherein the downhole tool may be configured to be set by one of hydraulic pressure, hydrostatic assist, or by a control line.

17. The method according to claim 15, wherein the second check valve connects the piston chamber to one of a wellbore annulus or tubing, and wherein the resettable piston includes a compressible energy source positioned between a second end of the resettable piston and the first portion of the piston chamber, the compressible energy source, when compressed, acting to push the resettable piston away from the activation chamber.

18. The method according to claim 17, wherein the second check valve is configured to allow fluid from the second fluid source into the first portion of the piston chamber to replenish fluid in the first portion of the piston chamber as the compressible energy source acts upon the resettable piston in response to releasing the pressure.

19. The method according to claim 15, where the pressure is applied to the port from the surface of the wellbore through one of an annulus of the wellbore or wellbore tubing.

20. The method according to claim 15, wherein the pressure amount P is applied via a control line.

* * * * *